United States Patent [19]

Gillies et al.

[11] Patent Number: 4,545,764

[45] Date of Patent: Oct. 8, 1985

[54] ROTARY KILN ASSEMBLIES, METHOD OF CHANGING SEAL ARRANGEMENTS AND SEAL ARRANGEMENTS FOR USE IN A ROTARY KILN ASSEMBLY

[75] Inventors: George M. Gillies, St. Annes; Leslie P. Kennett, Croft; Clive A. Mathews, Fulwood, all of England

[73] Assignee: British Nuclear Fuels Limited, Risley, England

[21] Appl. No.: 497,722

[22] Filed: May 24, 1983

[51] Int. Cl.[4] ..... F27B 7/38

[52] U.S. Cl. ..... 432/115; 432/242; 34/242

[58] Field of Search ..... 432/115, 103, 242, 244; 34/242

[56] References Cited

U.S. PATENT DOCUMENTS

| | | | |
|---|---|---|---|
| 2,826,403 | 3/1958 | Moklebust | 432/115 |
| 3,806,311 | 4/1974 | Barber | 432/115 |
| 3,940,239 | 2/1976 | Rossi et al. | 432/115 |
| 4,103,899 | 8/1978 | Turner | 432/115 |
| 4,111,439 | 9/1978 | Schmidt | 432/115 |
| 4,193,756 | 3/1980 | Leon | 34/242 |
| 4,199,154 | 4/1980 | Mueller | 432/115 |
| 4,212,632 | 7/1980 | Conrad et al. | 432/115 |
| 4,338,868 | 7/1982 | Lientz | 432/115 |

*Primary Examiner*—Henry C. Yuen

*Attorney, Agent, or Firm*—William R. Hinds

[57] ABSTRACT

A rotary kiln assembly comprising an inlet arrangement, a rotary kiln and an outlet arrangement. A seal arrangement is provided between the inlet arrangement and the rotary kiln and a seal arrangement is provided between the rotary kiln and the outlet arrangement. It is a problem with rotary kiln assemblies to remove the seals without relative movement of the rotary kiln or the inlet or outlet arrangements. At least one of the seal arrangements is made retractable in telescopic manner and the kiln assembly includes detachable spacing means such that the retractable seal arrangement can be removed from the kiln assembly as a unit without fouling or movement of the kiln or the inlet or outlet arrangements and hence without disturbing their alignment. The spacer means may be detachable only after retraction of the sealing arrangement and may be integral with a part of the sealing arrangement.

6 Claims, 5 Drawing Figures

ROTARY KILN ASSEMBLIES, METHOD OF CHANGING SEAL ARRANGEMENTS AND SEAL ARRANGEMENTS FOR USE IN A ROTARY KILN ASSEMBLY

BACKGROUND OF THE INVENTION

This invention relates to rotary kiln assemblies, a method of changing seal arrangements and to seal arrangements for use in a rotary kiln assembly.

Rotary kiln assemblies may be used for gas/liquid/-solid counter or co-current reactions and comprise an inlet arrangement, the rotary kiln itself and an outlet arrangement. It is to be understood that materials can be fed into or extracted from either the inlet arrangement or the outlet arrangement. Seal arrangements are needed between the inlet arrangement/rotary kiln and between the rotary kiln/outlet arrangement so that loss of valuable materials can be avoided and, in the case of unpleasant or toxic substances, escape of materials may be prevented.

It is desirable for maintenance purposes that seal arrangements be changed on a periodic basis and, of course, if a seal arrangement should fail it is desirable that it should be replaced with minimum loss of production. Unfortunately, replacement of seal arrangements is not straightforward because there are constraints upon what part of the kiln assembly can be moved, owing to inconvenience associated with time and effort related to disturbance of and consequent difficulties of re-alignment of the rotary kiln assembly and with associated equipment, especially in the case of large kilns. In particular, relative movement between parts of the kiln assembly is best avoided during seal changing.

One type of rotary kiln assembly is described in United Kingdom Patent Specification Ser. No. 1341379, but there is no teaching in this specification concerning how seal arrangements should be changed, nor that such changing is desirable. Further, one of the seal arrangements shown in the above-numbered British Patent Specification cannot be removed without axial movement of the rotary kiln or outlet arrangement.

An object of the present invention is to seek to provide a rotary kiln assembly able to have its seal arrangements changed without relative movement of the rotary kiln or outlet arrangement, a method of changing seal arrangements and a seal arrangement for use in rotary kiln assembly.

SUMMARY OF THE INVENTION

According to the present invention a rotary kiln assembly in which a first seal arrangement is disposed between an inlet arrangement and a rotary kiln, a second seal arrangement is disposed between the rotary kiln and an outlet arrangement, and at least one of the seal arrangements is retractable in telescopic manner, includes detachable spacing means such that the said one of the seal arrangements can be removed from the kiln assembly as a unit without fouling or movement of the kiln or the inlet or outlet arrangements.

By means of the invention a seal arrangement may be provided in which sufficient distance is available for thermal expansion of the rotary kiln assembly, yet the seal arrangement can be changed without movement of the rotary kiln or inlet/outlet arrangement. The spacing means may be integrally formed into the seal arrangement or it may be detachable therefrom. A detachable spacing means may also provide an added axial length to the seal arrangement, whereby a material conveying passage comprising spacing means and a tube and of greater axial length than the seal arrangement without such spacer means may be used, yet the seal arrangement may be removed without any fouling by the tube.

A seal arrangement for use in a kiln assembly in accordance with the invention may comprise a guide tube releasably connected to the kiln and rotatable therewith, sealing means surrounding the guide tube, and housing means for the sealing means so releasably mounted on the inlet arrangement or the outlet arrangement that retraction of the said sealing arrangement is effected at least in part by sliding of the guide tube and the sealing means relative to each other.

Preferably, the sealing means comprise lip seals.

DESCRIPTION OF THE DRAWINGS

The present invention will not be specifically described, by way of example only, with reference to the accompanying drawings, in which.

DESCRIPTION OF PREFERRED EMBODIMENTS.

Figure 1:
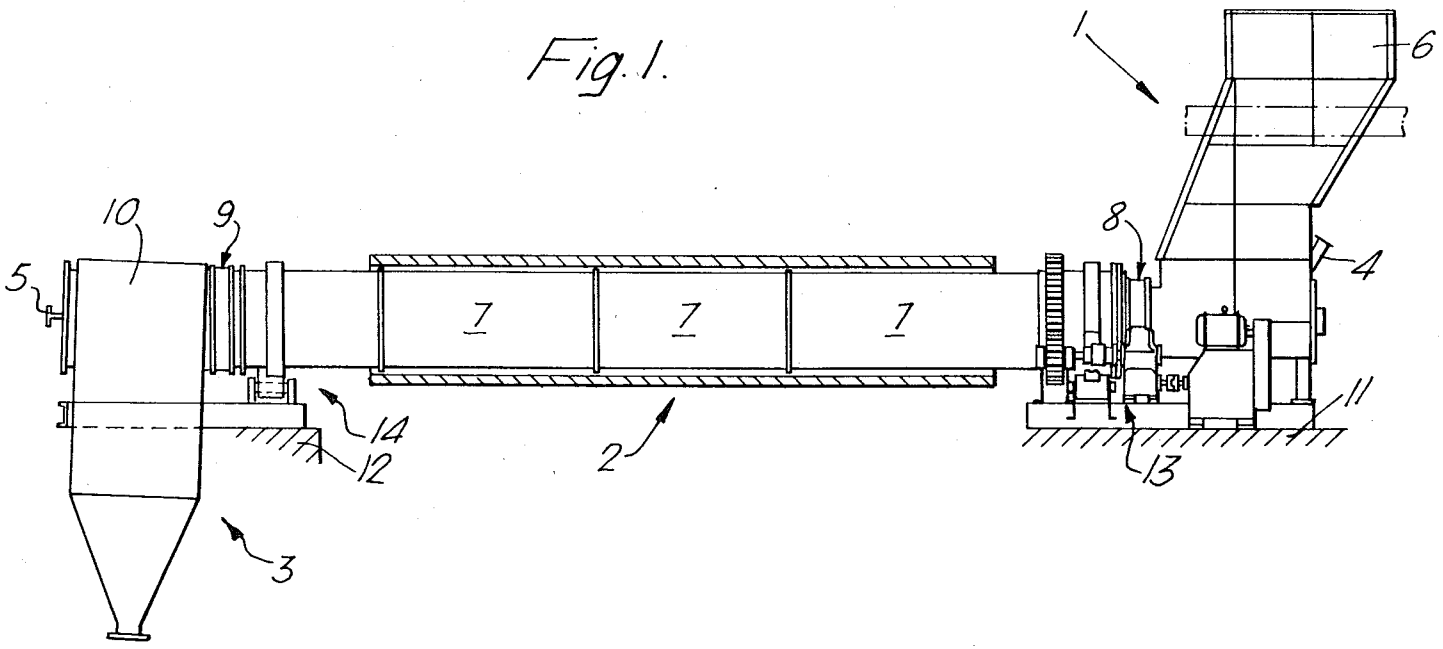
FIG. 1 is a diagrammatic view of a rotary kiln assembly.

Reference is directed firstly to FIG. 1, in which a rotary kiln assembly is shown to comprise an inlet arrangement 1, a rotary kiln 2 and an outlet arrangement 3. The inlet arrangement includes a reactant material inlet 4 and a feed hopper 6 and the outlet arrangement includes a material inlet 5 and a discharge hopper 10. The rotary kiln itself includes a number of separately temperature-controllable sections 7, so that a desired temperature profile can be obtained within the kiln. A seal arrangement 8 is disposed between the inlet arrangement 1 and the rotary kiln 2. A seal arrangement 9 is disposed between the rotary kiln 2 and an outlet arrangement 3. The kiln assembly is supported on concrete supports 11 and 12, to the right and left of the figure, respectively. A drive arrangement 13 is disposed on the support 11 so as to be able to rotate the rotary kiln 2. The kiln is rotatably mounted on the support 12 by an arrangement 14.

The rotary kiln assembly may operate in a range of temperature extending from room temperature to hundreds of degrees Celsius, so that allowance must be made for thermal expansion of components within the kiln assembly as different parts at different temperatures cause thermal expansion differentially. In particular, the rotary kiln 2 is likely to expand differently to the inlet and outlet arrangements 1 and 3. Therefore, the seal arrangements 8 and 9 allow for relative movement between the inlet arrangement 1, rotary kiln 2 and outlet arrangement 3. The support arrangement 14 for the kiln assembly allows for longitudinal movement of the rotary kiln 2. The mounting arrangement at the other end of the kiln 2 is axially fixed. There is a further constraint on the system in that the seal arrangements 8 and 9 are arranged to permit their removal and replacement, for maintenance purposes and in case of breakdown, without changing axial displacement between the rotary kiln 2, the inlet arrangement 1 and the outlet arrangement 3.

Figure 2:
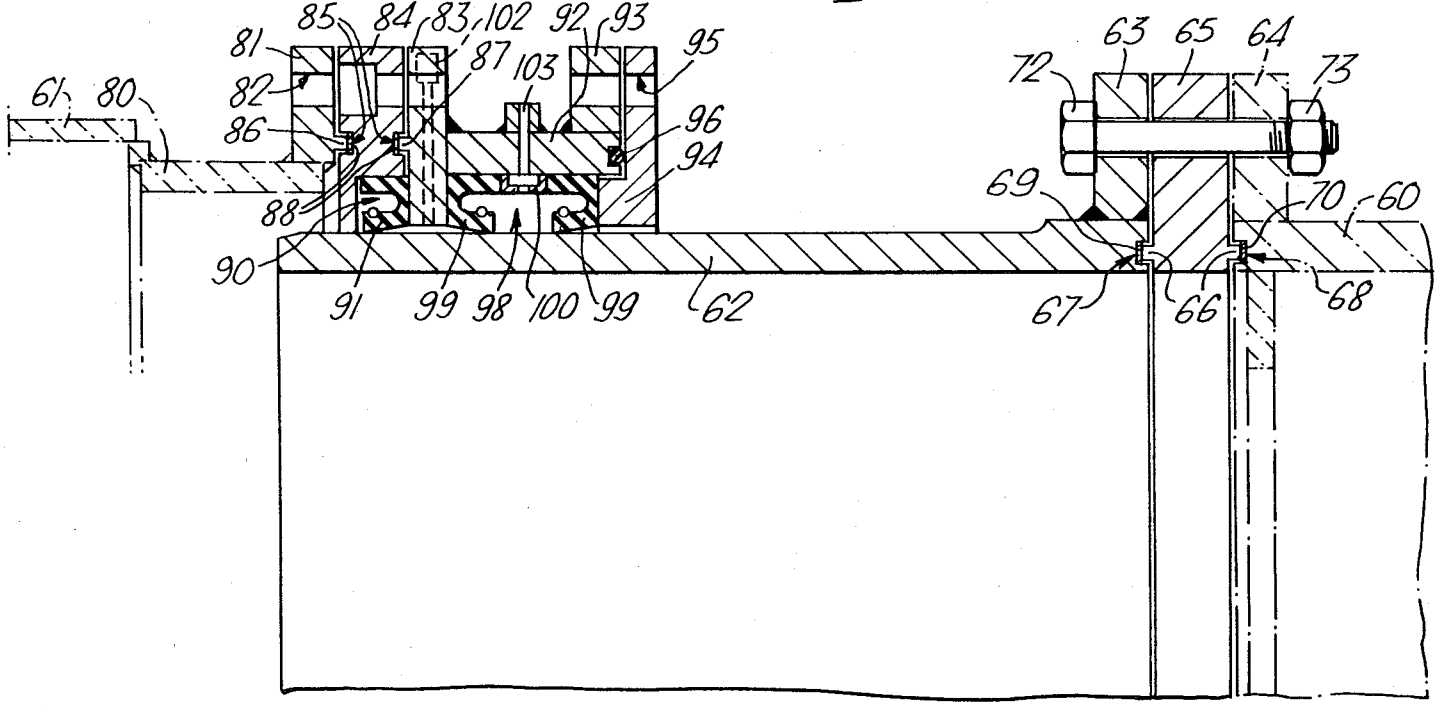
FIG. 2 is a diagrammatic view of part of a seal arrangement utilised in the rotary kiln assembly of FIG. 1.

Reference is now directed to FIG. 2, which is a sectional view and shows the port of the seal arrangement 9 in more detail. In FIG. 2 a wall of the rotary kiln 2 is indicated by 60 and a wall of the outlet arrangement by 61. The seal arrangement 9 includes a cylinder 62 of similar diameter to the kiln 60. The cylinder 62 carries a welded flange 63 and the kiln wall 60 carries a flange 64. A spacer 65 comprising a ring member is disposed between the kiln wall 60 and cylinder 62. The spacer 65 has square section annular spigots 66 on either side thereof. One of the spigots 66 engages a recess 67 in the cylinder 62 and the other engages a recess 68 in the rotary kiln wall 60 in order to assist with alignment. Seal rings 69 and 70 are disposed in recesses 67 and 68, respectively. The cylinder 62 is secured to the kiln wall 60 by means of bolts 72, engaged by nuts 73, so that the spacer 65 is retained therebetween. In a cold condition, the axial length of the cylinder 62 and the spacer 65 is sufficient to enable a closed passageway to be provided from the wall 60 to within an annulus 80 forming part of the outlet arrangement 3. As the kiln increases in temperature, the cylinder 62 is moved leftwardly in FIG. 2 so that the cylinder moves further into the annulus 80. In the cold condition, the cylinder 62 does not have sufficient axial length, itself, to extend all the way from the kiln 60 to within the annulus 80, i.e. if there is no spacer member present.

The annulus 80 carries a flange 81 welded thereto. The flange 81 is bolted by bolts (not shown) which pass through bores 82 to a seal support member 83, via a seal retaining ring 84. The retaining ring 84 contains recesses 85 which are engaged by a spigot 86 on the flange 81 and a spigot 87 on the support member 83 to assist in location and alignment. Seals 88 are disposed in the recesses 85 to effect seals. An annular cavity 90 is defined by the retaining ring 84, support member 83 and cylinder 62. A lip seal 91 is arranged within this cavity. The lip seal 91 bears upon the cylinder 62 to effect a seal between the fixed retaining ring 84 and the rotating cylinder 62. The support member 83 has an annulus 92 welded thereto. This annulus carries a flange 93 and an L-section flange 94 can be bolted to the flange 93 via bore 95. An O-ring seal 96 is trapped between the L-section flange and flange 93. The support member 83, annulus 92 and L-section flange 94 define an annular cavity 98. The annular cavity 98 contains two lip seals 99, separated by a lantern ring 100. The lip seals 99 provide a reactant-tight seal between the stationary annulus 92 and the rotating cylinder 62, even when the cylinder 62 moves axially due to thermal expansion of the kiln. Inert gas purge channels 102 and 103 are provided for pressurising the gaps between the lip seals 91 and 99.

Figure 3:
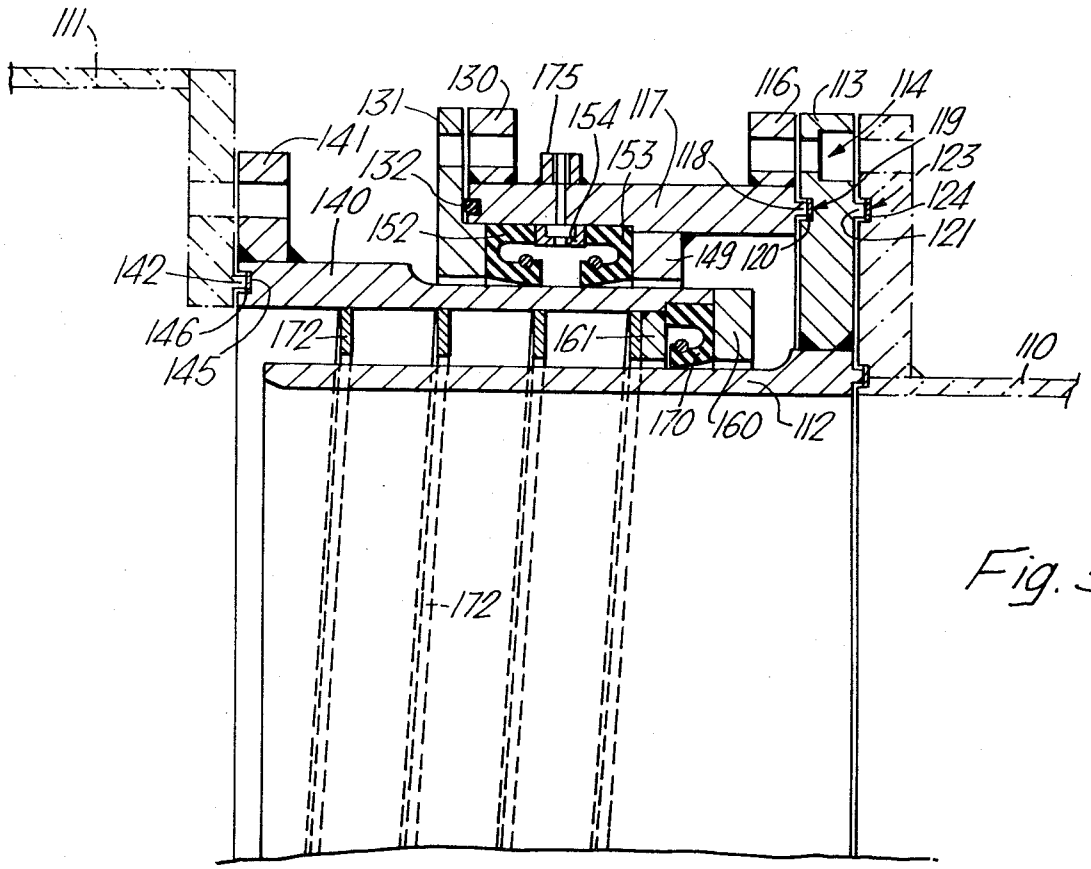
FIG. 3 is a similar view to FIG. 2, but of a different seal arrangement.

Reference is now directed to FIG. 3 in which part of the seal arrangement 8 is shown in more detail. In FIG. 3 part of the inlet arrangement is indicated by 110 and part of the kiln by 111. The seal arrangement comprises a cylinder 112 which is clamped to the inlet arrangement by means of a flange 113 containing a ring of holes 114 through which pass bolts (not shown), the bolts also passing through a flange 116 on a seal support member 117. The support member 117 is provided with an annular spigot 118 which engages a corresponding recess 119 in the flange 113. A seal 120 is disposed between spigot 118 and the inner wall of the recess 119. In a similar manner, a spigot 121 is provided on the flange 113 and this spigot engages a recess 123, there being provided a seal 124 between the spigot and the recess. The support member 117 carries a flange 130 whereby there is bolted to it an L-section ring 131. An O-ring seal 132 is disposed between the ring 131 and the support member 117. A cylindrical member 140 of diameter greater than the cylinder 112 is bolted to the rotary kiln by means of a flange 141 attached by set screws in blind holes (not fully shown in the figure). A spigot 42 is provided on part 111 of the rotary kiln and this spigot engages a recess 145 in the cylindrical member 140, there being a seal 146 disposed between the spigot and the cylindrical member. The cylindrical member 140, the L-section ring 131 and the support member 117, together with a ring 149 which is welded within the support member 117, define an annular space which contains two lip seals indicated by 152 and 153, respectively. A lantern ring 154 separates the lip seals 152 and 153. In use of the kiln, the stationary lip seals 152 and 153 bear upon the cylindrical member 140 and provide a seal against escaping materials. The cylindrical member 140 carries, at its end away from the kiln, a ring 160. A little way from the end a further ring 161 is welded to the cylindrical member 140. The cylindrical member 140, the ring 160 and the ring 161 define an annular space which contains a lip seal 170. This lip seal bears upon the cylinder 112, providing a seal against escapaing material between the cylinder 112 and the cylindrical member 140. Also mounted on the inside of the cylindrical member 140 is a rotating scroll of reverse pitch, blades of which are indicted by 172.

In use of the kiln assembly, while the drive end of the rotary kiln is located in position by the support 11, the inlet arrangement may expand due to thermal expansion. If this should happen, then the seal arrangement 8 is able to accommodate this movement. What happens is that the cylindrical member 140 moves from left to right in FIG. 3 and the seal retains its integrity because the lip seals 152 and 153 continue to bear on the outer surface of the cylindrical member 140, while the seal 170 continues to run on the outer surface of the cylinder 112. A gas purge connection 175 allows inert gas to be fed between the lip seals 152 and 153 to pressurise the seals. A purge is also provided between the seal 170 and the seal 153.

As was mentioned in the introduction to this Patent Specification it is important that seal arrangements in the rotary kiln assembly can be changed periodically for the purposes of maintenance when necessary and if any seal arrangement should break down in use. It is also important that the seals can be replaced without unnecessary axial movement of the inlet or outlet arrangements relative to the rotary kiln. In this connection, reference is again directed to FIG. 2, from which it can be seen that the seal arrangement 9, including the spacer 65, cannot be removed as a whole from the kiln arrangement without the cylinder 62 fouling the outlet arrangement 61. When the kiln is hot, so that the cylinder 62 extends well within the wall of the outlet arrangement, this position not being shown in the drawing, then any attempt at removal would be even worse. However, even when the kiln is cold, it is an advantage (although it is obviously not then essential) for the cylinder to extend into the outlet arrangement as shown in FIG. 2 in order that a thoroughly guided passage is provided for materials from the kiln into the outlet arrangement. It is, of course, essential that a seal is provided at all times. From FIG. 2 it can be seen that when the bolts 72 are removed the spacer 65 can be lifted up free of the kiln and the cylinder 62, the cylinder 62 being moved slightly into the outlet arrangement to telescope the seal arrangement and allow the spacer 65 to be lifted because the mechanical engagement constituted by the spigots 66 is released. Once the spacer 65 has been lifted clear of the rotary kiln and the cylinder 62, the cylinder 62 can be moved from left to right in FIG. 2, provided the member 83 and ring 84 have been unbolted from the flange 81. The cylinder 62 is moved to the right sufficiently far for the cylinder 62 to move clear of the outlet arrangement. The spacer 65, which was removed, had a width sufficient to allow this movement. Thus, the entire seal arrangement, can be removed as a unit, without increasing the axial separation of the outlet arrangement and the kiln. Once removed, the lip seals 91, 99 can be replaced, the cylinder 62, which contains a bearing surface, can be removed and any other part which may have become worn or out of alignment, for example owing to thermal stressing, can be replaced. Once the necessary parts have been replaced for the purposes of maintenance or repair, then the seal arrangement 9 can be replaced in reverse manner to its removal. Thus, the cylinder 62, the seals 91 99, and the parts 83, 84, 92 and 94 are all repositioned and the member 83 and ring 84 rebolted together to the flange 81. It is possible for the cylinder 62 to be inserted within the outlet arrangement without fouling it since the spacer 65 is not present. The cylinder 62 is then positioned to allow room for the spacer 65 to be inserted and lined up with its spigots 66 engaging in recesses 67, 68 the cylinder 62 is lined up with the spacer 65 and, last of all, the bolts 72 are reinserted.

Reference is now directed to FIG. 3, so that removal of the seal arrangement 8 can be explained. The seal arrangement 8 is removed by detaching bolts which secure the flange 141 to the part 111 of the kiln and which secure the flange 116 and the flange 113 to the part 110 of the inlet arrangement. Having removed these bolts, it will be appreciated that it is not possible to lift the seal arrangement out in its entirety, because the spigots 142 and 121 and a spigot on the cylinder 112 foul the kiln and the inlet arrangement since they are inserted in their respective recesses. However, it is not desirable to move the kiln axially relative to the inlet arrangement so that another method of removing the seal has to be found. The seal arrangement is telescoped by moving the outer cylindrical member 140 from left to right in FIG. 3 and moving the inner cylinder 112 axially from right to left in FIG. 3. This movement is performed to an extent which is just sufficient to enable the seal to be lifted free of the kiln and the inlet arrangement without fouling either of them. Once removed, the lip seals 152, 153 and 170 can be removed for replacement, as can the cylinder 112 and the cylindrical member 140 or any other parts. Reassembly of the seal arrangement 8 is a reverse of disassembly. The seal is inserted in its telescoped condition and then the flange 141 with the cylindrical member 140 is moved leftwards (in FIG. 3) and the cylinder 112 with the flanges 113, 116 is moved rightwards (in FIG. 3). The flange 141 can then be bolted to the part 111 of the kiln and the flanges 113, 116 can be bolted to the part 110 of the inlet arrangement, the spigots all having been correctly lined up and inserted.

Figure 4:
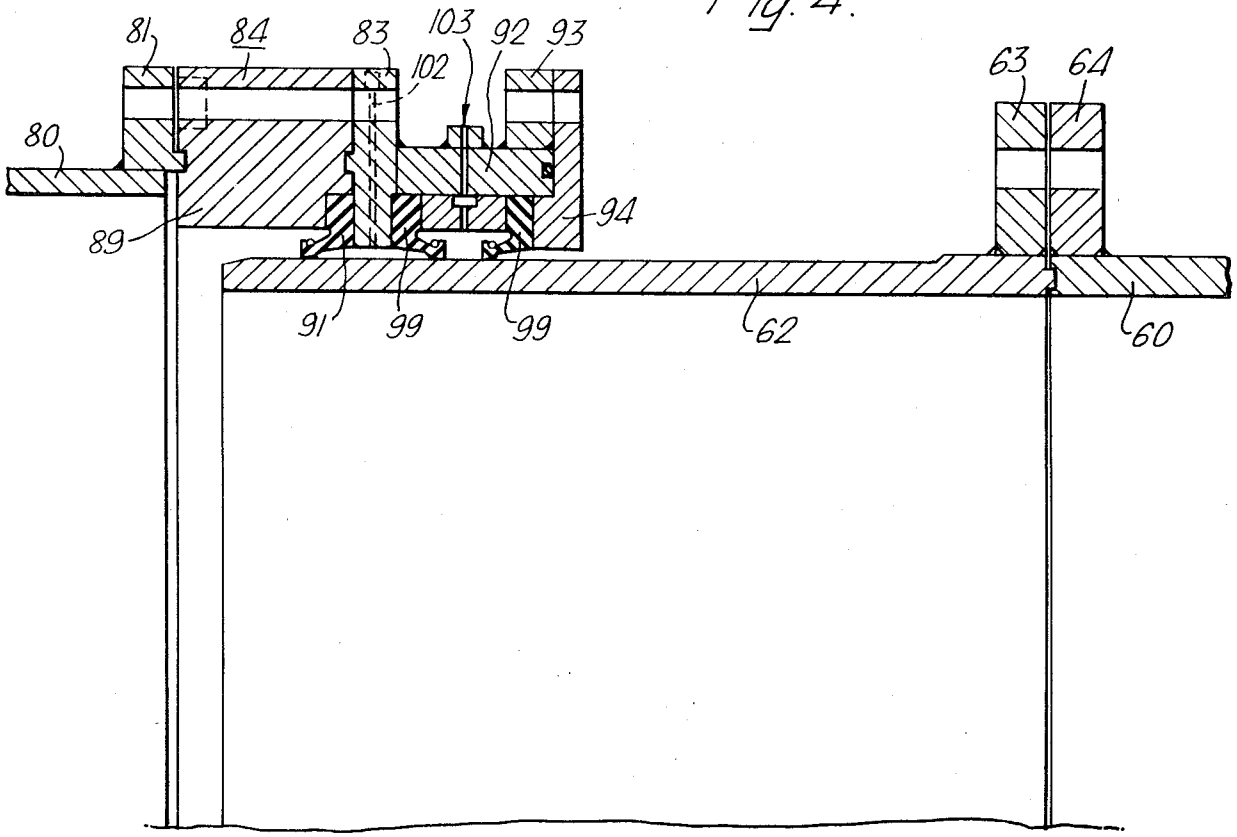
FIG. 4 is a similar view to FIG. 1, but of a third seal arrangement.

Reference is now directed to FIG. 4, in which like reference numerals to FIG. 2 are used for like parts. A principal difference between FIG. 4 and FIG. 2 is that the spacer 65 is not present, but in place of this retaining ring 84 has an extension 89 giving the ring 84 a greater axial length (i.e. an integral spacer is provided). This seal arrangement may be used in relatively larger rotary kiln assemblies with larger expansions and temperature differentials. The seal arrangement can be changed by telescoping of the seal arrangement by moving the ring 84 rightwardly in FIG. 4 and the cylinder 62 leftwardly in FIG. 4. In this embodiment of a seal arrangement for large rotary kiln assemblies, the cylinder 62 does not extend, when cold, from the rotary kiln to the outlet arrangement, although of course it does when hot. However, even in a cold condition, the seals sweep the cylinder 62.

Figure 5:
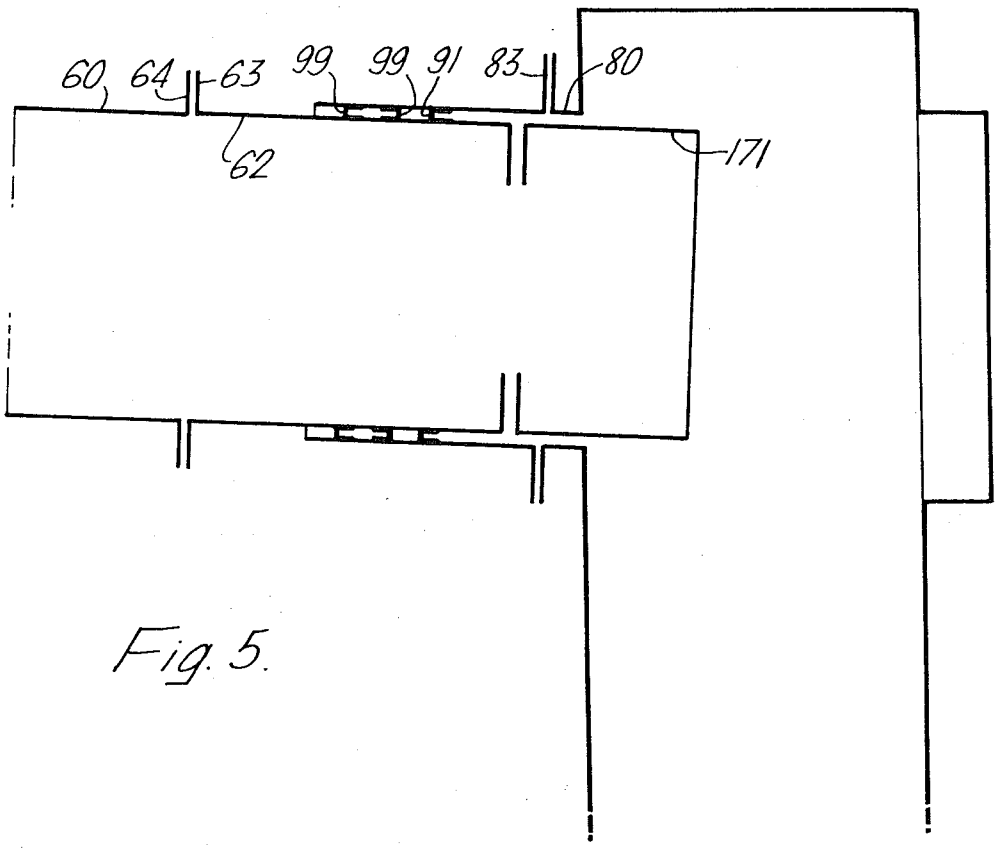
FIG. 5 is a diagrammatic view of a fourth seal arrangement.

Reference is now directed to FIG. 5, in which a fourth embodiment of a seal arrangement is shown and wherein like reference numerals to FIGS. 2 and 4 are utilised for like parts. This seal arrangement is shown only diagramatically, but it can be seen that an extension tube 171 is provided on the cylinder 62 of FIG. 4. This is in order to ensure that a guide tube is provided, even when the kiln assembly is cold, between the rotary kiln and the outlet arrangement. The extension can be considered to be a spacing means.

We claim:

1. A rotary kiln assembly in which a first seal arrangement is disposed between an inlet arrangement and a rotary kiln, a second seal arrangement is disposed between the rotary kiln and an outlet arrangement, and at least one of the seal arrangements is axially telescope and retractable, the kiln assembly also including detachable axial spacing means for removal for enabling said one of the seal arrangements to be removed from the kiln assembly as a unit for maintenance without fouling or movement of the kiln or the inlet or outlet arrangements, the spacing means being detachable from the kiln assembly only after retraction of the said one of the sealing arrangements.

2. A rotary kiln assembly in which a first seal arrangement is disposed between an inlet arrangement and a rotary kiln, a second seal arrangement is disposed between the rotary kiln and an outlet arrangement, and at least one of the seal arrangements is axially telescopic and retractable, the kiln assembly also including detachable axial spacing means for removal for enabling said one of the seal arrangements to be removed from the kiln assembly as a unit for maintenance without fouling or movement of the kiln or the inlet or outlet arrangements, wherein said one of the sealing arrangements comprises a guide tube releasably connected to the kiln and rotatable therewith, sealing means surrounding the guide tube, and housing means for the sealing means so releasably mounted on the inlet arrangement or the outlet arrangement that retraction of the said sealing arrangement is effected at least in part by sliding of the guide tube and the sealing means relative to each other.

3. A rotary kiln assembly as claimed in claim 2 wherein the spacing means is integral with a part of the housing means.

4. A rotary kiln assembly as claimed in claim 2 wherein the guide tube is fitted with an extension of its end remote from the kiln and the extension is detachable from the guide tube prior to removal of the said one of the seal arrangements as a unit from the kiln assembly.

5. A rotary kiln assembly as claimed in claim 2 wherein the said one of the seal arrangements includes a further tube within the guide tube and further sealing means provided on the guide tube to surround the further tube, the further tube being releasably mounted with the housing means on the inlet arrangement or the outlet arrangement so that the guide tube and the further tube are slidably axially relative to each other.

6. A rotary kiln assembly as claimed in claim 2 wherein the sealing means comprise lip seals.

* * * * *

UNITED STATES PATENT AND TRADEMARK OFFICE

CERTIFICATE OF CORRECTION

PATENT NO. : 4,545,764

DATED : October 8, 1985

INVENTOR(S) : GEORGE M. GILLIES; LESLIE P. KENNETT; and CLIVE A. MATHEWS

It is certified that error appears in the above—identified patent and that said Letters Patent is hereby corrected as shown below:

In the heading of the patent, after "[22] Filed: May 24, 1983", insert the following:

[30] Foreign Application Priority Data

June 3, 1982 [GB] United Kingdom.....8216228

Signed and Sealed this

*Seventeenth* Day of *December 1985*

[SEAL]

*Attest:*

DONALD J. QUIGG

*Attesting Officer*

*Commissioner of Patents and Trademarks*